United States Patent [19]

Lee

[11] 4,040,624

[45] Aug. 9, 1977

[54] PULL CORD RIGHTING PORTABLE TARGET

[76] Inventor: Robert Wayne Lee, 3895 W. 2nd Ave., Hialeah, Fla. 33012

[21] Appl. No.: 660,913

[22] Filed: Feb. 24, 1976

[51] Int. Cl.[2] ..... F41J 7/04

[52] U.S. Cl. ..... 273/102 AP

[58] Field of Search ..... 273/102 AP, 102 R, 102 S, 273/102.1 E, 102.1 F, 102.1 D, 127 D, 41

[56] References Cited

U.S. PATENT DOCUMENTS 1,657,931 1/1928 Krantz ..... 273/102 AP

*Primary Examiner*—William H. Grieb

[57] ABSTRACT

A knock-over target device for small arms such as pellet guns. Independently acting permanent targets are pivotally mounted to a base and are connected together by a bridle. After the targets have been knocked over, strategically located bridle guides enable the bridle, when activated by an attached pull cord, to exert a downward pull on the bottom edges of the prone targets, thereby returning the targets to an upright position again--ready for the next shot. This is accomplished from either the marksman's location, or from a wide range of oblique angles relative to the line of fire.

17 Claims, 5 Drawing Figures

PULL CORD RIGHTING PORTABLE TARGET

This invention relates to target devices, and more specifically to a knock-over type target that is reset by a pull cord. Up to the present time, there were no simple, portable, pull-cord righting target devices available to the amateur marksman. Consequently, the enjoyment and safety of this type target has not been available to the shooting public.

It is, therefore, a primary object of this invention to provide such a target device; one that can be economically manufactured because it contains no complicated mechanism, weights, or springs in achieving the desired results.

Another object is to provide a safe, enjoyable, and convenient means of target practice in which the target is shot down and then pulled up again from either the firing location or from a wide range of oblique angles relative to the line of fire.

It is a further object of this invention to save the time and energy spent walking back and forth between the target and the shooting location while re-setting the fallen targets.

It is still another object to eliminate the necessity of looking for and finding an object that can be used as a target.

It is still another object of this invention to provide an easily transported, stored, and long lasting target.

The achievement of these and other objects of the present invention will be fully apparent from the following description of a specific embodiment, when read in conjunction with the accompanying drawings in which.

Figure 1:
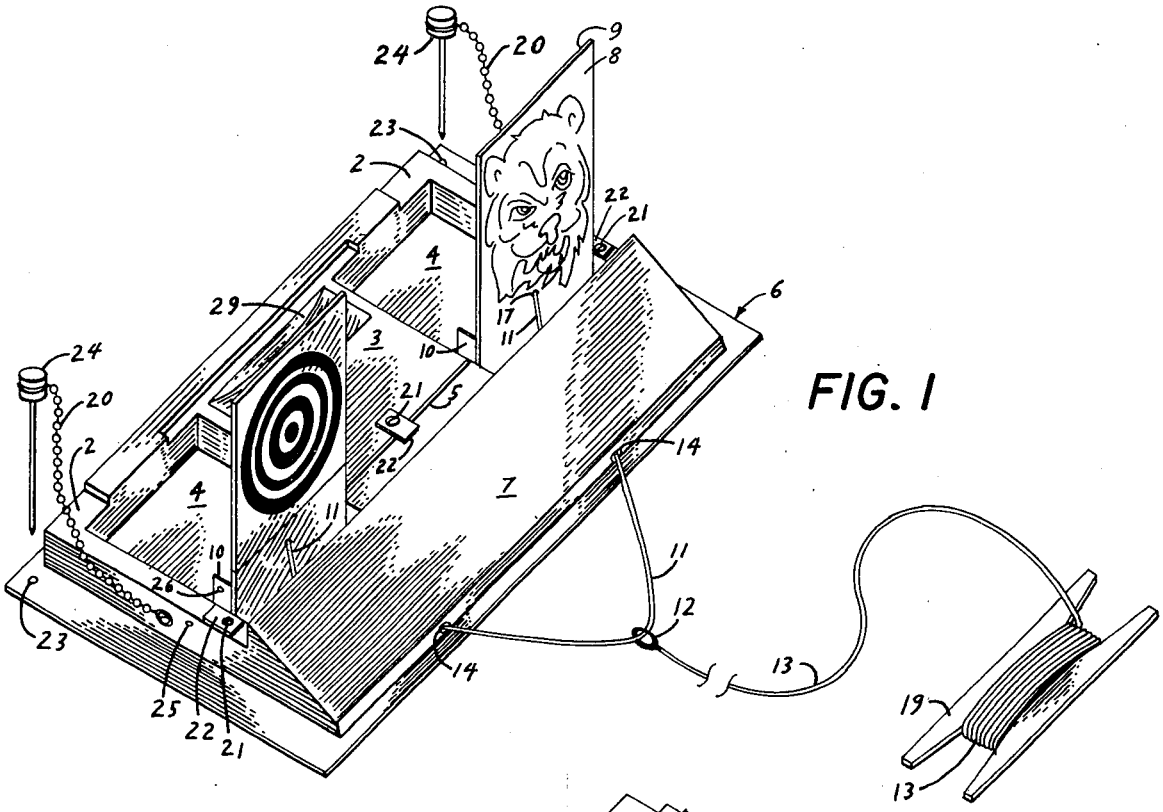
FIG. 1 is a perspective view of the target device and pull cord showing both target elements in an upright position.
Figure 3:
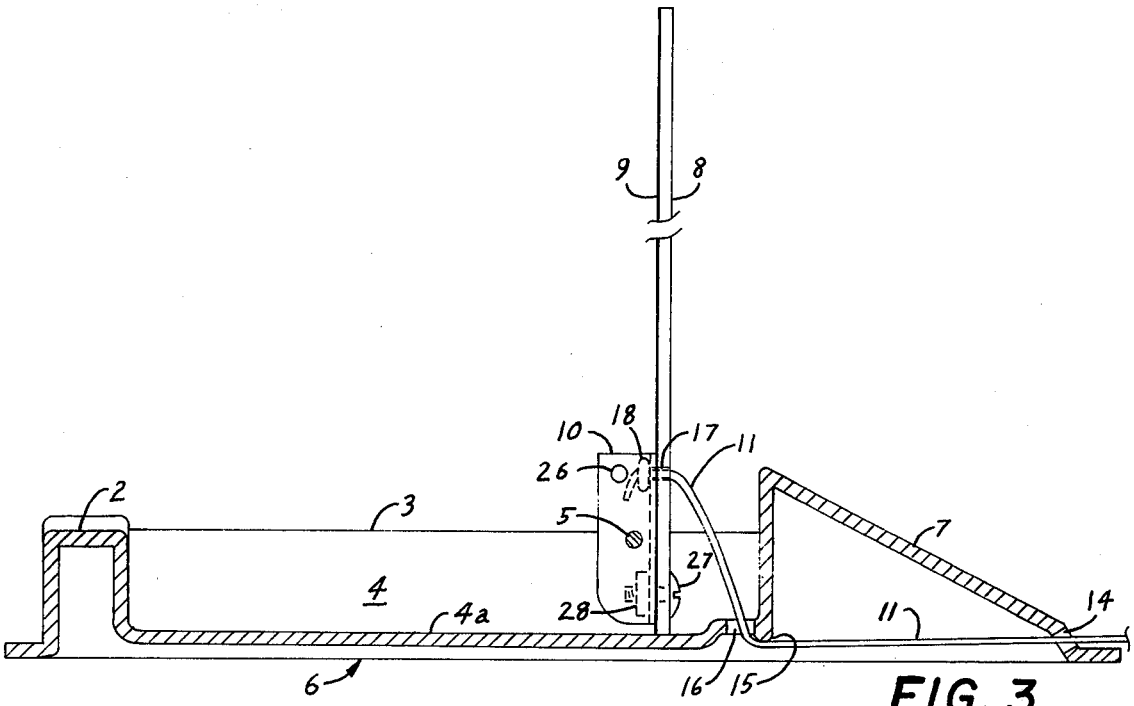
FIG. 3 is a sectional view with the target element in an upright position, taken along the line 3—3 of FIG. 5, and looking in the direction of the arrows.
Figure 4:
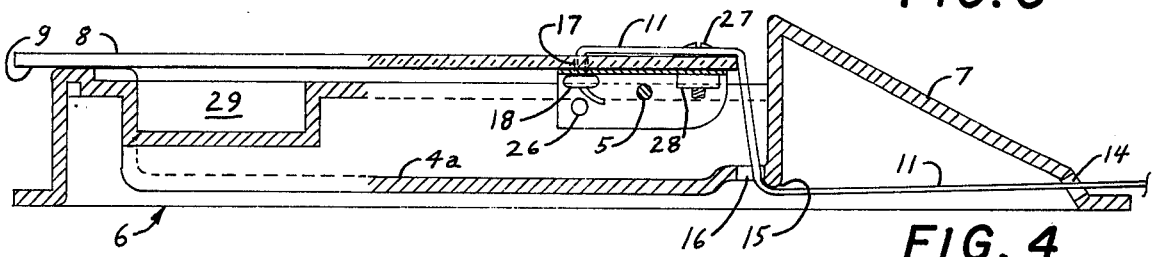
FIG. 4 is a sectional view with the target element in a prone position, taken along the line of 4—4 of FIG. 5, and looking in the direction of the arrows.

Referring to the drawings and initially to FIG. 1, the numeral 6 indicates the base of the target device. The base 6 is preferably formed from an appropriate high-impact plastic as defined through Plastic Standards Falling Dart Impact Tests. Walls 2 are formed around the back and sides of the base, and a plateau 3 of the same heighth occupies the center section of the base. This leaves a cavity or target well 4 between the plateau and each side wall. The front wall 7 of the target device is sloped. It is higher than the walls 2 and the pivot rod 5 best seen in FIG. 3, and also higher than the horizontally lying target element 8, FIG. 4. This prevents the targets from being struck at a point lower than the pivot rod 5, and protects the target elements and the bridle cord 11 from damage. The slope 7 also eliminates the possibility of a projectile ricochetting back towards the shooter's location. The pivot rod 5 transits apertures in the target pivot brackets 10 and is secured in slots in top of the walls 2 and the plateau 3 of the base 6 and anchored to them by screws 21 and securing plates 22. The pivot rod 5 is secured at a sufficient distance behind the front slope 7 to allow clearance of the bottom edges of the individually acting target elements 8. The pivot brackets 10 are attached to the backs of the target elements 8 by bolts 27 and nuts 28 that, when the target elements 8 are in a vertical position, they stand with their botton edges on the floor 4A of the target wells 4. When the target elements 8 FIG. 4 are in a prone position, their botton edges are higher than the pivot rod 5, and relatively much higher than the floor 4A of the target wells 4.

One end of the pull cord 13 is attached to a small ring or slidable pull cord connector 12. The slidable connector is transited by the target element bridle cord 11, or V-shaped flexible linkage of braided nylon cord or such. Consequently, the pull cord 13 slides along the bridle cord in relation to the direction of the force exerted with the attached pull cord. Therefore, the pull cord 13 can activate the bridle cord 11 from a wide range of angles relative to a perpendicular line from the front surface of the base 6, or the line of projectile travel. This enables a person other than the marksman, if so desired, to reset the targets from an oblique angle to the line of projectile travel. The ends of the bridle cord 11 are inserted through apertures, which serve as guides 14 in the sloping front 7 of the base 6 near ground level. The bridle cord ends continue under the front slope and around a curved protuberance 15 FIGS. 3 and 4. The protuberance 15 serves as an anti-chafing device for the bridle cord 11 as it enters the bridle cord master guides 16.

Apertures, serving as bridle cord master guides 16, are located in the floor 4A of the target wells 4. When the target element 8 FIG. 3 is in an upright position, the aperture is located closely adjacent to the bottom edge of the target element. When the target element 8 FIG. 4 is in a prone position, this aperture location is below the bottom edge of the target element.

The bridle cord 11 goes through the master guides 16 and its connection to the target elements is achieved by providing an aperture 17 in the lower center of each target element through which the bridle cord ends transit and terminate on the backside of the target elements with a knot 18 which is larger than the aperture. The knot 18 provides a terminal means for the bridle cord 11, and prevents the cord from being pulled back through the aperture. The knot, although not actually connected to the target element, cooperates with the bottom edge of the falling target element in pulling the bridle cord 11 upward and later assisting in pulling the bottom edge of the target element 8 downward while resetting the target elements to an upright position.

Figure 5:
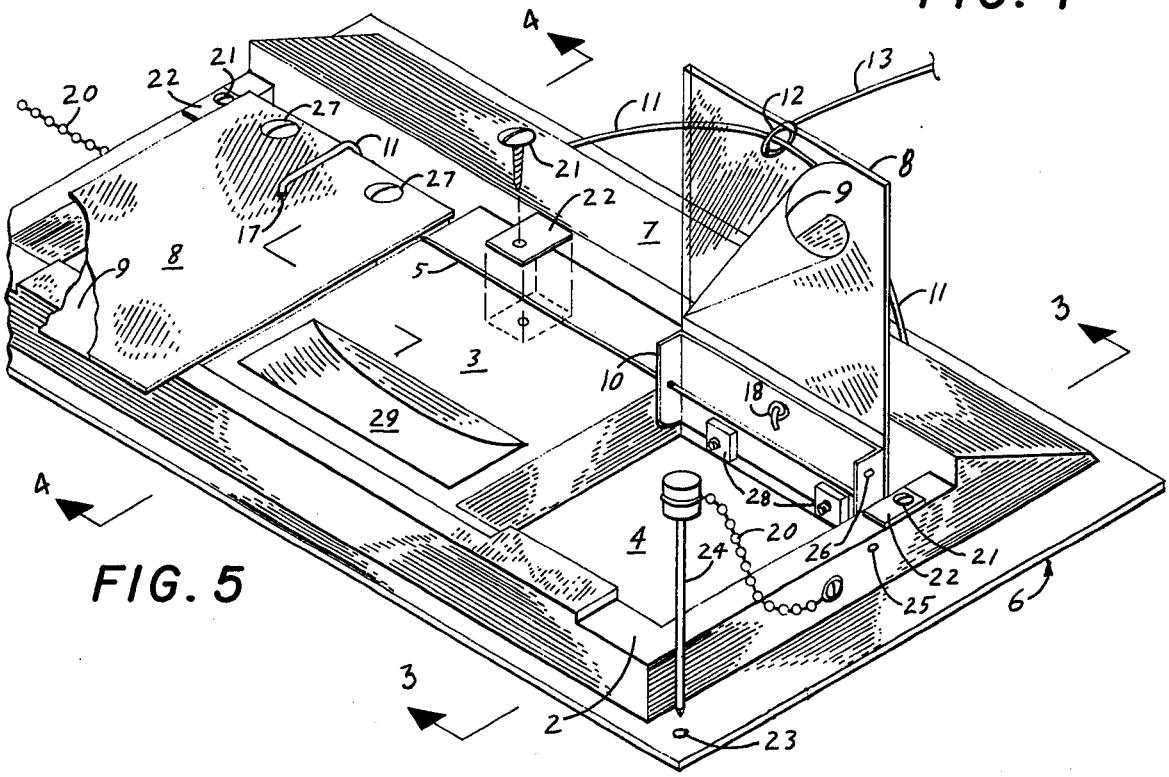
FIG. 5 is a perspective view looking from the rear.

Preferably, the single-plane target elements 8 are also constructed from a suitable high-impact plastic material as defined through Plastic Standards Falling Dart Impact Tests. This material may be clear and transparent, best seen in FIG. 5, and have an appropriate picture 9 such as a bulls-eye target or a wild animal permanently affixed to its backside. The marksman can thus see and shoot at the bulls-eye or "animal", and the transparent material will protect the picture 9 from damage.

The rear corners of the target device have apertures 23 that are used in conjunction with removable securing pins 24 for anchoring the target device to the ground or surface upon which the device is used. A chain 20 is used to attach the securing pins 24 to the base 6.

After one of the target elements 8 has been struck by a projectile, its top edge pivots backward and downward, and its bottom edge pivots upward. The bottom edge, aided by the knot 18, pulls the bridle cord 11 upward, guided by the bridle master guides 16. The second target element, when struck by a projectile, reacts in the same manner. When in this prone position, the target element 8, lies above the pivot rod 5, and the bridle cord 11 has been pulled substantially vertically upward through the bridle master guides 16 to the now elevated bottom edge of the prone target element 8.

To simultaneously reset the target elements to an upright position again, the shooter merely pulls on the end of the pull cord 13 or reel 19 lying at the shooter's location. As this end of the pull cord is moved forward, the other end of the pull cord 13 and the attached sliding connector 12 pulls the apex of the bridle cord 11 forward. Due to the location of the master guides 16, the bridle cord exerts a substantially vertical downward pull on the bottom edge of each of the prone target elements 8 and, in so doing, simultaneously pivots both of the target elements until they are standing in an upright position again.

Figure 2:
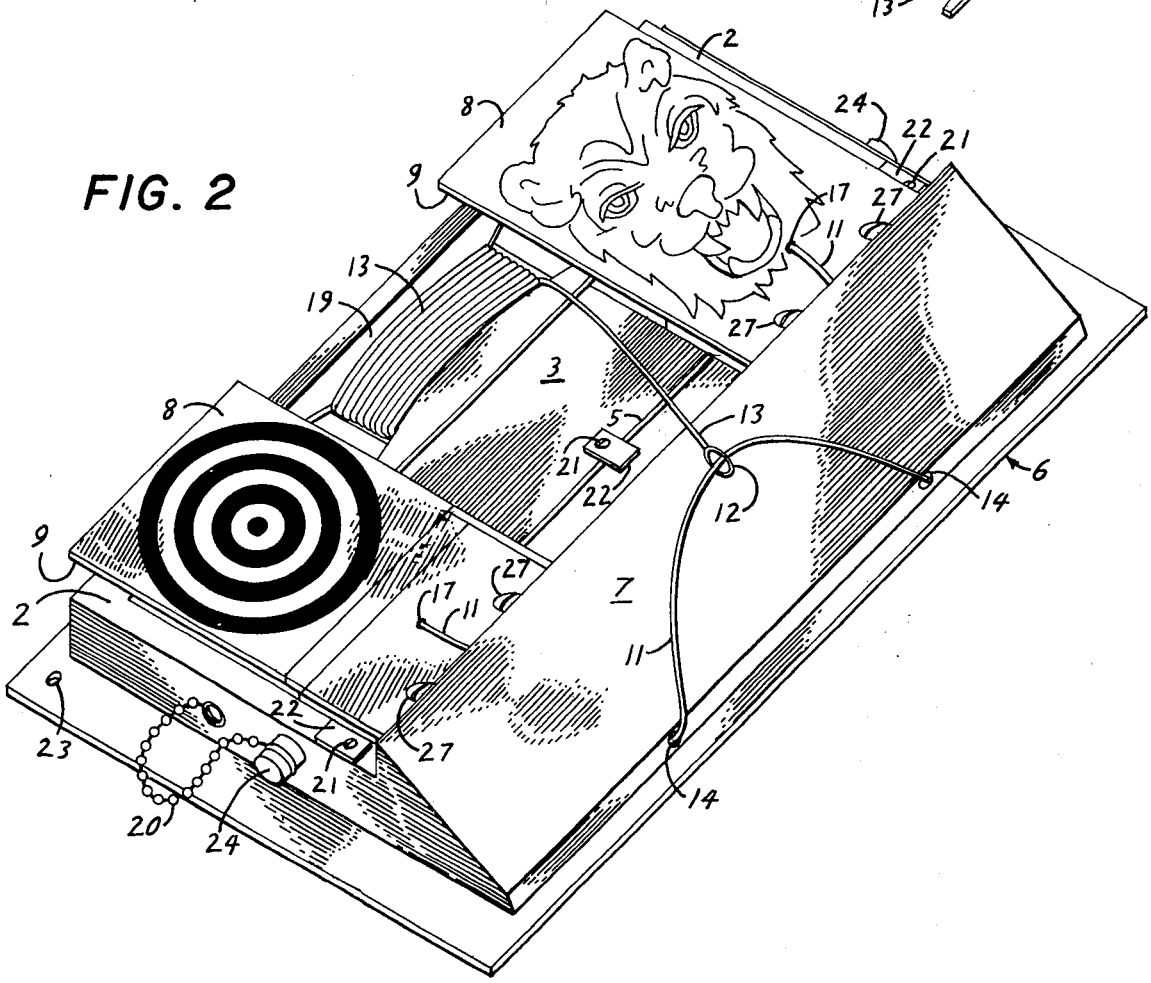
FIG. 2 is a perspective view showing both target elements in a prone position, and with the pull cord secured underneath them.

An additional feature of the base 6 is a storage facility for the pull cord 13. After the shooting session, the pull cord 13 is wound on a simple, flat, oblong storage reel 19. The ball of cord on the reel fits into a cavity 29 at the back of the plateau 3 of the base 6, and the ends of the reel 19 project underneath the prone target elements 8. The pins 24 are inserted through aperture 25 in the side walls 2, and aperture 26 in the target bracket 10. These apertures are aligned automatically when the target elements are laying in a horizontal position as in. This not only provides a storage place for the securing pins 24, but also immobilizes the prone target elements 8 and they, in turn, hold the pull cord reel ends 19 underneath them, thereby securing the pull cord 13 and reel 19 in the cavity 29, as seen in FIG. 2. These features facilitate the storing and transporting of the target device.

A modified form of this preferred embodiment of the present invention employs but one target element. In this version, the pull cord 13 is directly rigged and connected to the single target element through a master guide 16 in the same manner as the bridle cord was rigged and connected to each of the dual target elements.

The target device as herein described and shown in the drawings can be used by itself or, with simple adapters or attachments, in conjunction with other shooting accessories such as bullet traps or paper target frames.

As this invention may be embodied in several forms without departing from the spirit or essential characteristics thereof, the present embodiment is therefore illustrative and not restrictive.

Having described my invention, I claim:

1. A target device comprising a base means, at least two target elements mounted pivotly on said base means and mounted laterally to each other, and a target element resetting means; wherein said target element resetting means comprises a flexible bridling linkage of which one end terminates closely adjacent to one of said target elements, and the other end of said flexible bridling linkage terminates closely adjacent to another of said target elements, and wherein said flexible bridling linkage is maintained medially between said target elements.

2. The device of claim 1, and wherein said flexible bridling linkage is contained within the lateral boundaries defined by the outermost sides of said pivotable target elements.

3. The device of claim 1, and wherein said base has an aperture disposed closely adjacent to each of said target elements, and said aperture is transited by said flexible bridling linkage.

4. The device of claim 1, and wherein said base has an aperture disposed closely adjacent to the point of contact of the bottom edge of each said target element and said base and said aperture being transited by said target element bridling linkage and said aperture thereby guiding and enabling said bridling linkage to exert a substantially vertical downward pull on said prone target elements.

5. The device of claim 4, and wherein said base further comprises a curved protuberance around which said target element bridling linkage transits before entering said bridle guiding aperture, said protuberance thereby being an anti-chafing device for said bridling linkage.

6. A targert device comprising a base means, at least two target elements pivotly mounted to said base means, a target element bridling means, a pull cord, and a pull cord attaching means; and wherein said pull cord attaching means further comprises a slidable connector having an aperture through which said bridling means transits, and said pull cord is attached to said slidable connector thereby enabling said pull cord to activate said bridling means from an oblique angle relative to the front surface of said base means.

7. The device of claim 6, and wherein said target element bridling means further comprises a flexible bridling linkage of which one end terminates closely adjacent to one of said target elements, and the other end of said flexible bridling linkage terminates closely adjacent to another of said target elements, and wherein said flexible bridling linkage is maintained medially between said target elements.

8. A target device comprising a base that contains a target element pivot means, a target element that stands forwardly of said pivot means, and a pull cord; wherein said base has an aperture disposed closely adjacent to said target element, and said target element has an aperture in its' lower portion, both of said apertures being transited by said pull cord which terminates closely adjacent to said target element aperture.

9. The device of claim 8, and wherein said base is formed from a high impact plastic as defined by Plastic Standards Falling Dart Impact Tests.

10. The device of claim 8, and wherein said target element is formed from a high impact plastic as defined by Plastic Standards Falling Dart Impact Tests.

11. A target device comprising a base and a target element pivotly mounted to said base; wherein said target element further comprises at least a portion that is formed from a clear, transparent material and has a picture behind the front surface of said transparent material.

12. A target device comprising a base, a target element pivotly mounted to said base, and a securing pin; wherein said base and said target element each have an aperture that, when said apertures are aligned, accepts the insertion of said securing pin through said apertures thereby immobilizing said target element in a prone position.

13. A target device comprising a base, a target element pivotly mounted to said base, a target pull cord and reel; wherein said device further comprises, in combination, a storage means for said pull cord and reel, and a securing means for temporarily securing said pull cord and reel in said storage means.

14. The device of claim 13 and wherein said base has a cavity into which said pull cord and reel are inserted for storage, said cavity being disposed behind said target element.

15. A target device comprising a base, a target element pivotly mounted to said base, a target pull cord and reel, and a securing pin; wherein said base and said target element each have an aperture that, when aligned, accepts the insertion of said securing pin through said apertures, thereby immobilizing said target element in a prone position with said prone target element extending over at least a portion of said pull cord and reel, thereby securing said pull cord and reel to said base.

16. A target device comprising a base; two target elements pivotly mounted to said base; a pull cord; a pull cord connector having an aperture and being fastened to one end of said pull cord; a target element flexible bridling means for simultaneously pulling said target elements to an upright position, said bridling means transiting the aperture of said pull cord connector thereby slidably fastening said bridling means to said pull cord; aperture means disposed in said base through which said bridling means transits, said aperture means disposed closely adjacent to the point of contact of the bottom of each said target element and said base, said aperture means thereby guiding and enabling said bridling means to exert, when the attached pull cord is activated, a substantially vertical downward pull on said prone target elements; an aperture means disposed in the lower portion of each said target element, through which said bridling means transits and terminates adjacent to said aperture means of each said target element.

17. A target device comprising a base, a target element pivotly mounted on said base, a pull cord, and a pull cord reel; wherein said device further comprises, in combination, a storage means for said pull cord and reel, and a locking means for temporarily immobilizing said target element, thereby assuring a secure and compact target device while both storing and transporting said target device.

* * * * *

UNITED STATES PATENT OFFICE

CERTIFICATE OF CORRECTION

Patent No. 4,040,624 Dated August 9, 1977

Inventor(s) Robert Wayne Lee

It is certified that error appears in the above-identified patent and that said Letters Patent are hereby corrected as shown below:

Column 2, line 3, after "28" insert --or by other suitable means at such a height--.

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*